US007283027B2

(12) United States Patent
Batteux et al.

(10) Patent No.: US 7,283,027 B2
(45) Date of Patent: Oct. 16, 2007

(54) ELECTRIC SWITCHING DEVICE, RELAY, SOCKET AND ELECTRIC APPARATUSES COMPRISING SUCH A DEVICE

(75) Inventors: Pierre Batteux, Saint Pierre de Mesage (FR); Oleg Garelli, Saint Marcellin (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 58 days.

(21) Appl. No.: 11/081,756

(22) Filed: Mar. 17, 2005

(65) Prior Publication Data

US 2005/0219022 A1 Oct. 6, 2005

(30) Foreign Application Priority Data

Apr. 1, 2004 (FR) ..... 04 03433

(51) Int. Cl.
*H01H 9/00* (2006.01)

(52) U.S. Cl. ..... 335/179; 335/229; 335/185

(58) Field of Classification Search ..... 335/185, 335/190, 191, 229
See application file for complete search history.

(56) References Cited

U.S. PATENT DOCUMENTS

| | | | | |
|---|---|---|---|---|
| 3,470,505 | A | 9/1969 | Woodhead | 335/83 |
| 4,782,315 | A | 11/1988 | Bataille et al. | 335/234 |
| 5,272,458 | A | 12/1993 | Hoffman et al. | 335/179 |
| 5,394,131 | A * | 2/1995 | Lungu | 335/229 |
| 5,883,557 | A | 3/1999 | Pawlak et al. | 335/179 |
| 6,404,312 | B1 * | 6/2002 | Comtois et al. | 335/220 |
| 6,414,577 | B1 | 7/2002 | Hoffman | 335/229 |
| 7,138,894 | B2 * | 11/2006 | Lo | 335/179 |

* cited by examiner

*Primary Examiner*—Elvin Enad
*Assistant Examiner*—Bernard Rojas
(74) *Attorney, Agent, or Firm*—Steptoe & Johnson LLP

(57) ABSTRACT

Switching device comprising a contact block having a fixed part connected to at least one electric terminal and having at least one electric contact zone able to be in contact with a contact zone of a movable part, an actuating device enabling the movable part to be moved from a closed position to an open position of said contact zones. The fixed part comprises two bases. The actuating device is formed by at least one electric coil placed between the bases. The movable part comprises a magnet able to move between two stable positions. The magnet comprises an electric contact zone electrically connected to a first electric terminal and able to be electrically in contact with contact zones connected to a second electric terminal.

21 Claims, 15 Drawing Sheets

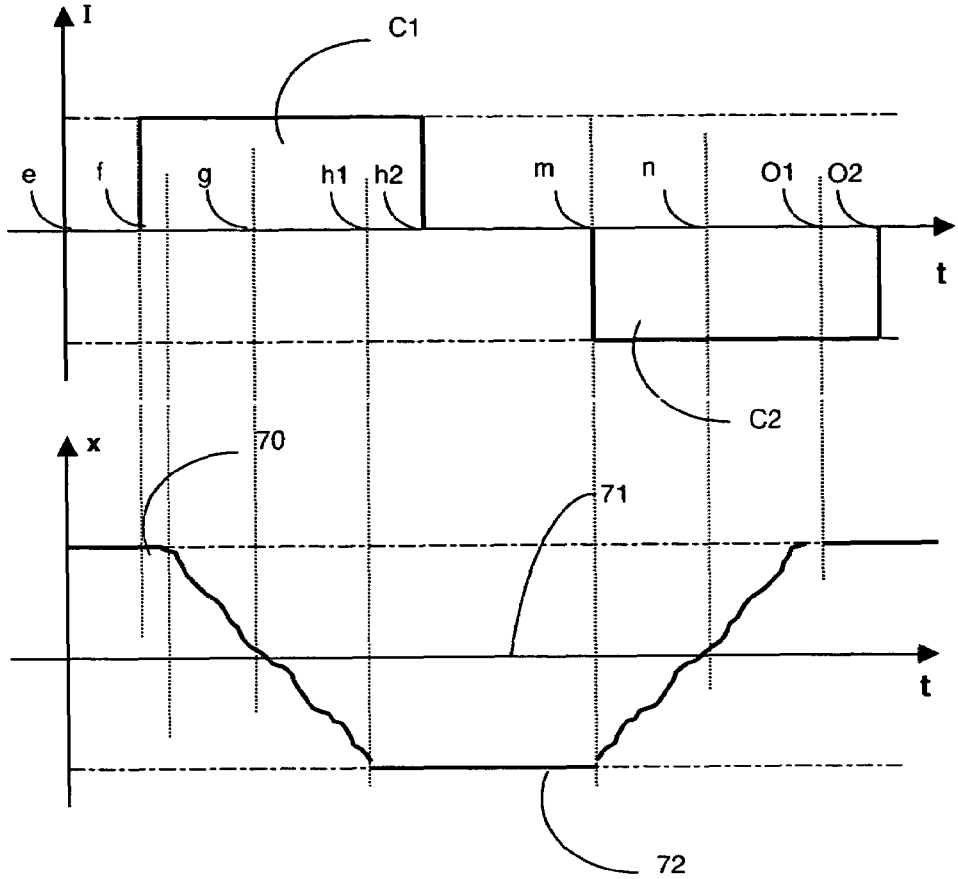
Fig. 13a
Fig. 13b
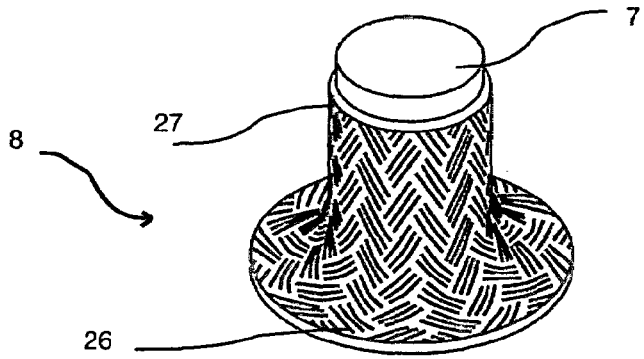
Fig. 14

ELECTRIC SWITCHING DEVICE, RELAY, SOCKET AND ELECTRIC APPARATUSES COMPRISING SUCH A DEVICE

BACKGROUND OF THE INVENTION

The invention relates to a switching device comprising a contact block having a fixed part connected to at least one electric terminal and having at least one electric contact zone able to operate in conjunction with a contact zone of a movable part, an actuating device enabling the movable part to be moved from a closed position to an open position of said electric contact zones.

STATE OF THE ART

In a conventional electric installation, remote making and breaking of the electric current are generally performed by means of contactors or relays.

These very extensively used items of equipment in particular comprise electromagnetic actuating means designed to command movement of one or more movable contacts with respect to one or more stationary contacts from a closed position to an open position and vice-versa. The actuating means in particular comprise electric coils and permanent magnets (EP 0,686,989 B1, EP 0,272,164 B1).

Furthermore, these numerous equipment items differ from one another in particular by their number of contacts or the number of positions of the contacts according to the control currents. For example, conventional contactors or relays or more complex apparatuses with two stable positions called bistable are to be found.

These apparatuses manufactured in large series are formed by a case housing the contacts and the actuating means. Connection means enable the case to be connected with the electric devices to be controlled.

However, fitting these apparatuses in confined environments can give rise to certain problems. It does for example become difficult to integrate them in an electric socket 40 as represented in FIG. 1. A known electric socket comprises a plinth 29 arranged in a space 28 of a size suitable for receiving said plinth. In known manner, the spaces 28 are arranged in the walls or partitions present in the rooms of residential premises. The plinth 29 comprises two sleeves 31 in which a plug supplying an electric appliance is inserted. These sleeves 31 are respectively connected to electric wires of the mains power system via power supply terminals 30. The electric wires are secured to the power supply terminals 30 by fixing means 32.

Due to the size and characteristics of known switching devices and of the associated remote control means, in particular a radio module, it is very difficult to position all these components inside the space 28. Moreover, the power circuit has to transit via connecting wires between the terminals 30 of the socket and a relay, and then from the relay to the sleeves 31 of the socket. The cumbersome presence of these wires and the numerous electric connections can generate harmful temperature rises. In addition, the assembly and wiring operations remain delicate and costly as they are difficult to automate.

To remedy these installation problems linked to the small amount of room available, solutions enable a socket 40 to be controlled remotely by means of external boxes connected on said socket. All the components used for control are then placed in a box 41 external to the socket 40. The box 41 is connected to the sleeves 31 of the socket by pins 44. The box 41 also comprises sleeves 31 in which a power supply plug of an electric apparatus is inserted.

A relay placed on at least one of the poles of the box 41 is controlled by a control module 45 receiving in particular opening or closing control orders of the relay by a radio module 46. The relay is connected in series between at least one pin 44 and the corresponding sleeve 31.

SUMMARY OF THE INVENTION

The object of the invention is therefore to remedy the shortcomings of the state of the technique so as to propose a simple switching device of small dimensions.

An electric switching device according to the invention comprises a fixed part comprising at least two bases made of magnetic or magnetizable material and electrically insulated from one another, an actuating device placed between said bases and formed by at least one electromagnetic coil able to magnetise the bases, a movable part placed inside the actuating device comprising at least one magnet moving between two stable positions respectively corresponding to a distinct electric state of the switching device, the magnet comprising at least one electric contact zone being electrically connected to a first electric terminal and able to be in electric contact in at least one of the two stable positions with at least one of the bases comprising an electric contact zone connected to a second electric terminal, the movable magnet operating a magnetic attraction with one of the two bases.

In a particular embodiment, the actuating device comprises an electric coil having a winding designed to create a magnetic field to polarize the bases with opposite magnetic polarities.

According to a development of the invention, the actuating device comprises an electric coil having two winding sections connected in series and having opposite winding directions so that said sections respectively create opposite magnetic fields.

The actuating device preferably comprises two coaxial electric coils connected in such a way as to create opposite magnetic fields.

The two bases preferably have the same magnetic polarities.

Advantageously, in one of the two stable positions, the magnet comprises an electric contact zone in contact with a contact zone connected to a second electric terminal.

Advantageously, in both of the two stable positions, the magnet comprises an electric contact zone in contact with a contact zone respectively connected to a second electric terminal.

Advantageously, respectively in each stable position, the magnet operates a magnetic attraction with one of the two bases.

According to a development of the invention, the metal bases are respectively connected to two distinct connection terminals.

The magnet is preferably electrically connected to one of the two metal bases by a flexible connection.

In a particular embodiment of the invention, the magnet is electrically connected to a third electric terminal by a flexible connection.

The movable magnet preferably moves in a direction parallel to the longitudinal axis of the coils and inside the coils of the actuating device.

The metal bases preferably have studs positioned salient on their internal faces, the studs of said bases being placed facing one another and aligned with the longitudinal axis of the coils.

Preferably, a side wall made of magnetizable material extends between the two electrically insulated bases.

A relay according to a development of the invention comprises at least two electric contact terminals and at least two electric control inputs and comprises a switching device as defined above, the coils of said device being connected to the control inputs and the bases of said device being connected to the contact terminals.

An electric apparatus according to a development of the invention comprises thermal tripping means and resetting means and comprises a switching device as defined above associated to the thermal tripping means and to the resetting means.

Advantageously, the resetting means comprise a press-button acting on the movable part of the switching device via control means.

Advantageously, the thermal tripping means comprise a bimetal strip acting on the movable magnet via control means.

Advantageously, the thermal tripping means are electrically connected to one of the electric terminals.

A control circuit of the actuating device of the switching device as defined above sends a single repulsion control order or two consecutive repulsion and attraction control orders or two simultaneous attraction and repulsion control orders.

A socket according to a development of the invention comprises a plinth whereon at least two sleeves connected to connection terminals are fixed, and comprises a switching device as defined above connected between at least one sleeve and one connection terminal.

BRIEF DESCRIPTION OF THE DRAWINGS

Other advantages and features will become more clearly apparent from the following description of a particular embodiment of the invention, given as a non-restrictive example only and represented in the accompanying drawings in which:

FIG. 13*a* represents a curve representative of the control signal of the switching device according to FIGS. 10 to 12;

FIG. 13*b* represents a curve representative of the movement of the switching device according to FIGS. 10 to 12;

FIG. 14 represents a detailed view of the movable part of the device according to an embodiment of the invention;

DETAILED DESCRIPTION OF AN EMBODIMENT

Figure 1:
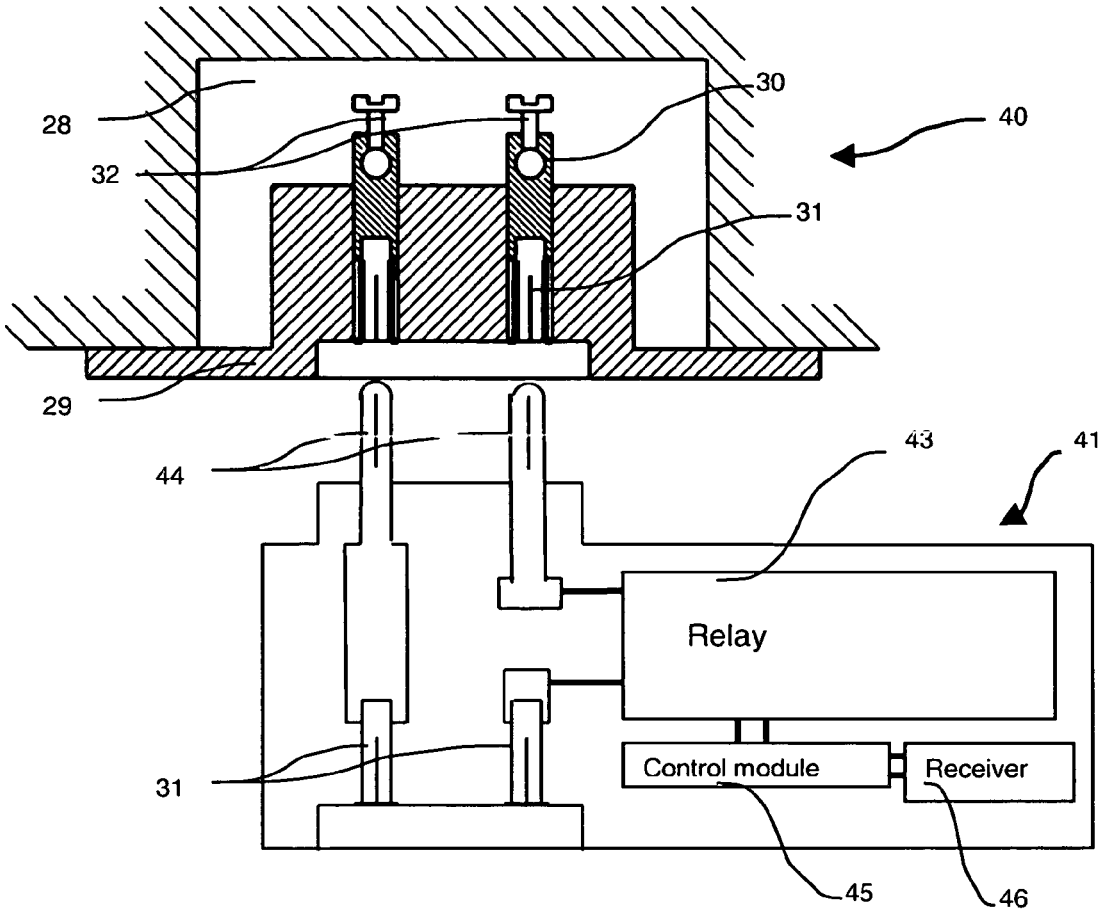
Fig. 1 (Prior art)
FIG. 1 is a schematic cross-sectional view of a socket comprising a switching device of known type.

The electric switching device according to an embodiment of the invention presented in FIGS. 3 to 7 is a bistable switching device. It can take two stable operating states respectively corresponding to closed or open positions of the electric terminals A, B. In this embodiment, the switching device 1 is made up of a fixed part 2 comprising a first base 22 and a second base 23. The two bases 22, 23 made of magnetic or magnetizable material, preferably of cylindrical shape, are respectively connected to electric connection terminals A, B. These terminals A, B are themselves connected to an electric circuit. The two metal bases 22, 23 are electrically insulated from one another. The bases are preferably arranged in such a way that their internal faces 24 and 25 are facing one another, for example in parallel manner.

The space 10 comprised between the two bases is occupied by an actuating device 5. This device is formed, according to the embodiment presented, by an electric coil 55 the longitudinal axis Y whereof is substantially perpendicular to the internal faces 24, 25 of the bases 22, 23 of the fixed part 2.

The electric coil 55 is supplied between two inputs 11 and 12 by a power source able to send electric current or impulse commands. This impulse power source can in particular be constituted by a previously charged capacitor.

In order for lines of an electromagnetic field 62 produced by the coil 55 to be able to close, the internal faces 24, 25 of the bases 22, 23 are preferably placed as close as possible to the radial faces of the coil 55. In the example embodiment, the external diameter of the cylindrical bases 22, 23 is advantageously at least equal to the external diameter of the coil 55.

In the embodiment presented, to obtain an electric insulation between the bases 22, 23 and the coil 55, said coil is positioned in a support 9 made of electrically insulating material permeable to the electromagnetic field created by the coil 55 when an electric current I flows through the latter.

In order to be able to perform electric switching between terminals A and B, a movable part is positioned in the space 10 confined by the volume situated inside the coil 55 of the actuating device 5 and between the internal surfaces of the two bases 22, 23 of the fixed part 2.

The movable part of the actuating device according to this embodiment of the invention is formed by a permanent magnet 7 connected to one of the two electric terminals A, B by a flexible connection 8. This connection 8 has both mechanical and electric characteristics. It allows a movement of the magnet 7 in translation in a direction parallel to the longitudinal axis Y of the coil 55 and it is moreover used as electric power conductor between the terminals A and B. One of the two bases 22, 23 can have a common electric connection 85 with the flexible connection 8, for example the base 22. In addition, the base 22 and connection 8 can be connected to an electric terminal A.

In the embodiment as represented in FIG. 14, the flexible connection is formed by a metal braid of general cylindrical shape having one of its ends 26 in the form of a frustum. The end 26 is in electric contact with the internal face 24 of the base 22. The permanent magnet 7 is fixed onto the second end 27 of the flexible connection 8.

To ensure a good electric connection between electric contact zones of the magnet and of the fixed part, the contact zones of the magnet can comprise electric contact studs. The contact studs can be made from usual contact material comprising in particular copper or silver. As represented in FIG. 14, the end 27 of the flexible metal braid is then welded directly onto the electric contact stud surrounding the magnet 7.

Movement of the magnet takes place over a total distance X hereinafter referred to as the total air gap X. In the example embodiment, the North pole of the magnet is arbitrarily positioned facing the internal face 24 of the base 22 and the South pole of the magnet is facing the internal face 25 of the base 23. The switching device will obviously operate according to the same actuating principles if the permanent magnet is turned so that its North pole is placed facing the internal face 25 of the base 23.

The distance separating the contact zones, equal to the total air gap X, is set so as to ensure insulation distances of the product in which the switching device 1 is used. For example purposes, if the switching device 1 is intended for control of a socket 40, the air gap is at least 3 millimetres in the open position.

Figure 3:
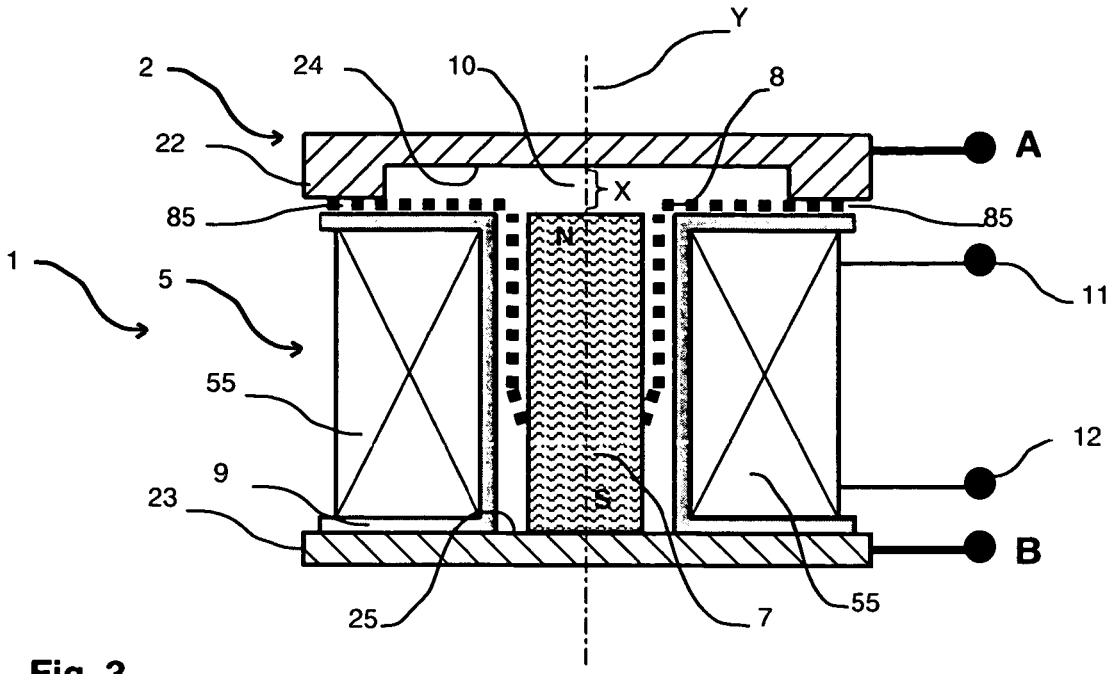
FIG. 3 represents a cross-sectional view of a switching device according to an embodiment of the invention.
Figure 7:
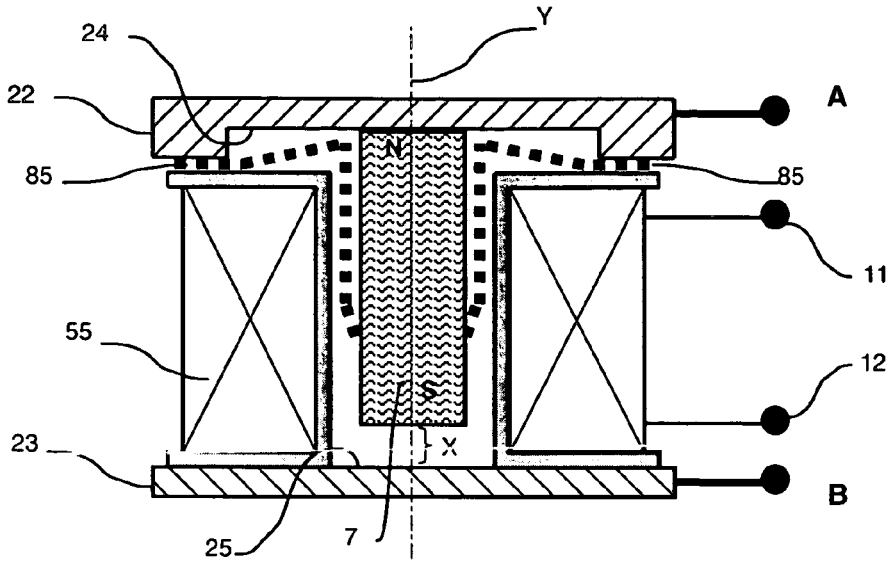

As represented in FIGS. 3 and 7, the switching device comprises two stable operating states. A first operating state where the magnet 7 is stuck to the internal face 25 of the base 23. A second state where the magnet is then stuck to the internal face 24 of the base 22.

When the coil 55 is not supplied, the actuating device 5 is then inoperative. The magnet 7 is then in a first or a second position, respectively stuck to the base 23 or to the base 22.

According to the embodiment represented schematically in FIG. 3, the terminals A and B are electrically connected to one another via the base 22, the flexible connection 8, a contact zone of the permanent magnet 7 and the base 23. The switching device is then closed.

According to the embodiment represented schematically in FIG. 7, the terminals A and B are no longer electrically connected, for the contact zone of the permanent magnet 7 is not in contact with the contact zone of the base 23. The switching device 1 is then open.

In order to optimize the quality of the electric contact zones of the fixed part, contact studs can be arranged on said contact zones of the internal faces of the bases 22, 23.

To switch from one stable position to the other, the operating steps are as follows.

For example, to switch from a closed state as represented in FIG. 3 to an open state as represented in FIG. 7, the inputs 11 and 12 of the coil 55 are respectively supplied so that the current I flowing in the coil 55 produces an electromagnetic field whose field lines have the effect of magnetizing the bases 22 and 23. Due to the geometry of the assembly and to the direction of the current I in the windings of the coil 55, the base 22 temporarily becomes a North pole whereas the base 23 becomes a South pole. The South poles of the magnet and of the base 23 repel one another with a repulsion force inversely proportional to a distance X1 squared. The distance X1 then corresponds to the distance of movement separating the magnet 7 from the base 23. The distance X1 tends to zero at the beginning of movement and is equal to the total air gap X at the end of movement.

Figure 4:
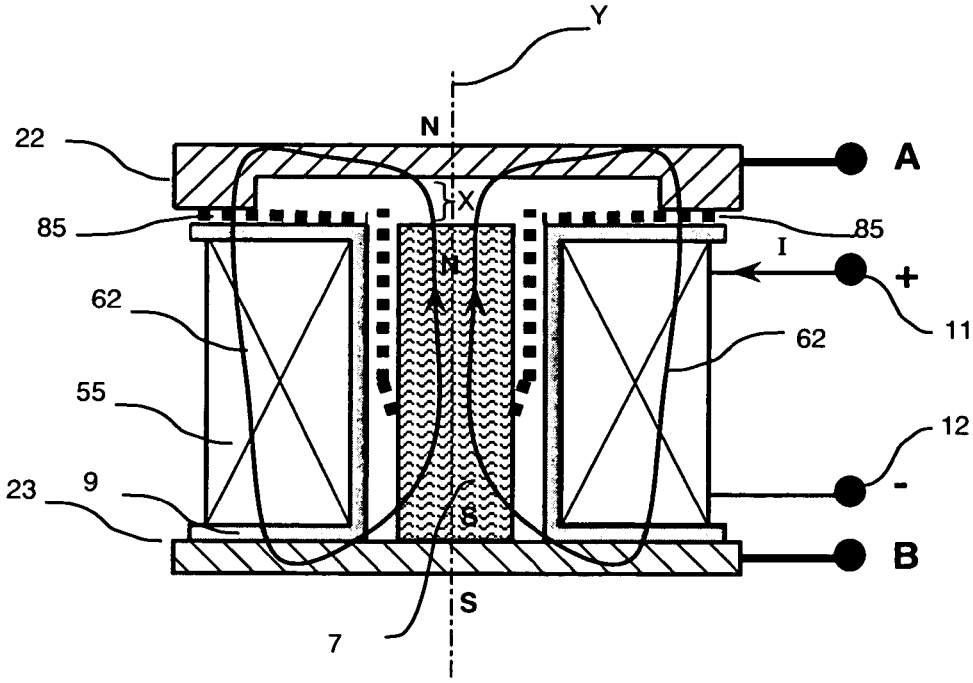
FIGS. 4 to 7 represent the device according to FIG. 3 in different operating states.

As soon as the magnet starts to move due the action of the repulsion force, the contact zone of the movable part is no longer in contact with the contact zone of the fixed part, and the terminals A and B are therefore no longer connected. As represented in FIG. 4, the movable magnet moves in the direction 14 following a direction parallel to the longitudinal axis Y of the coil 55. In a midway position, when the distance covered X1 is about equal to half the total air gap X, the repulsion forces respectively South-South and North-North are of equal intensity and tend to balance each other out.

The inertia forces exerted on the magnet 7 during movement keep it at a certain speed which enables it to pass beyond this midway position.

Figure 6:
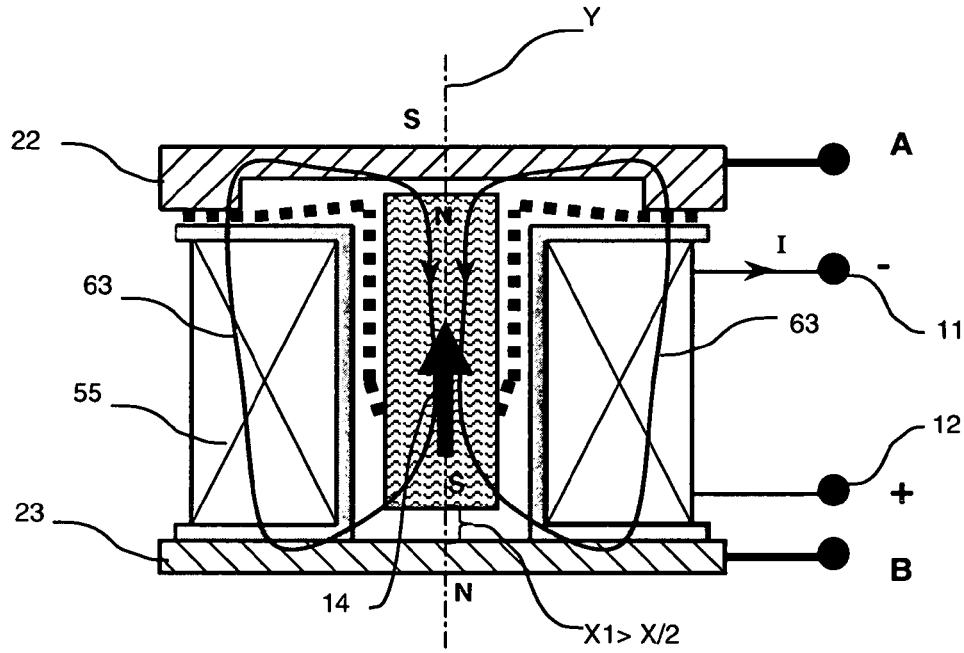

As represented in FIG. 6, the direction of the current I in the coil is reversed which causes a change of the direction of rotation of the electromagnetic field lines produced by the coil 55. The magnetic polarity of the bases 22, 23 is also reversed, the base 22 becomes a South pole and the base 23 becomes a North pole.

The North pole of the permanent magnet is then attracted by the base 22. The attraction forces between the North and South poles respectively of the magnet and of the base 22 are directly proportional to the square of the distance separating them. Thus, the closer the magnet 7 moves to the base 22 the greater the attraction force.

As soon as the magnet is in contact with the internal face 24 of the base 22, the device can then stop supplying power to the coil 55. The bases 22 and 23 are no longer polarized by the coil and the switching device 1 is in a new stable state. The electric terminals A, B are no longer electrically connected and the switching device is then open.

Figure 5:
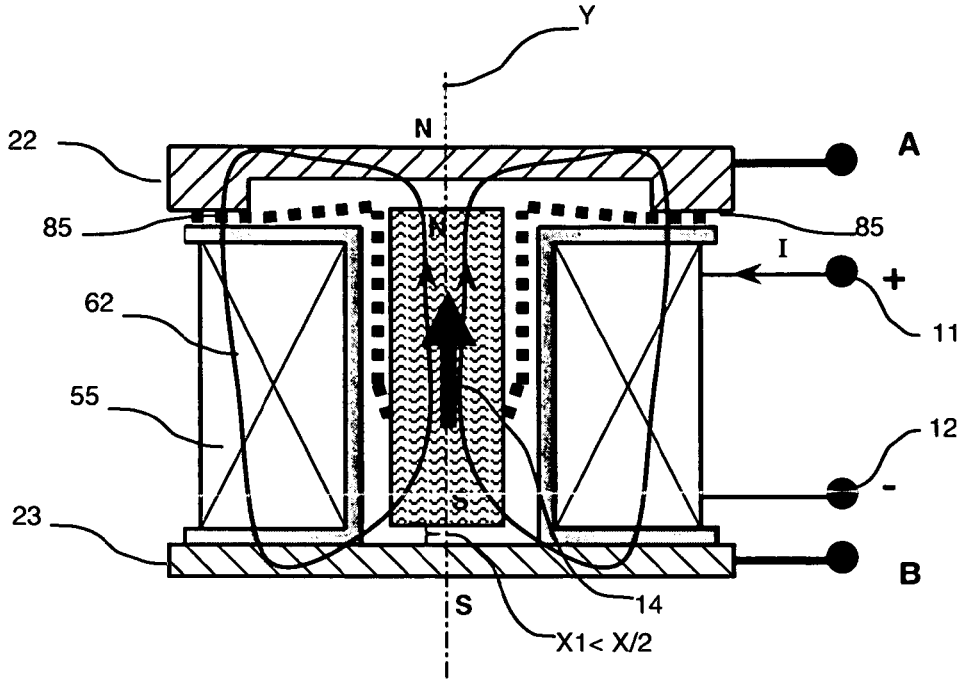
Figure 8A:
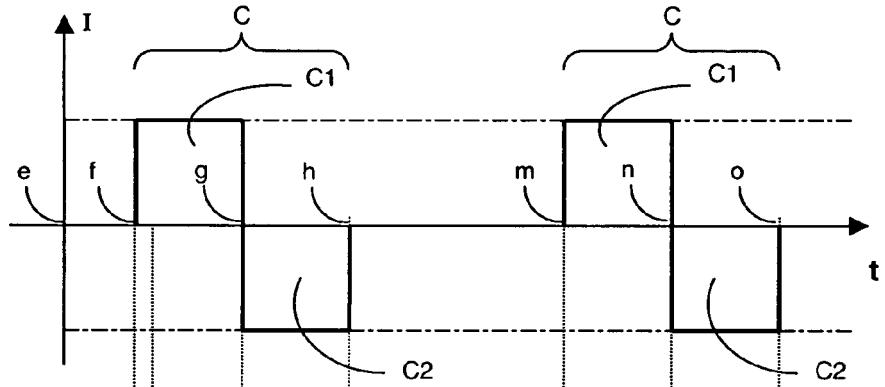
FIG. 8*a* represents a curve representative of the control signal of the switching device according to FIGS. 3 to 7.
Figure 8B:
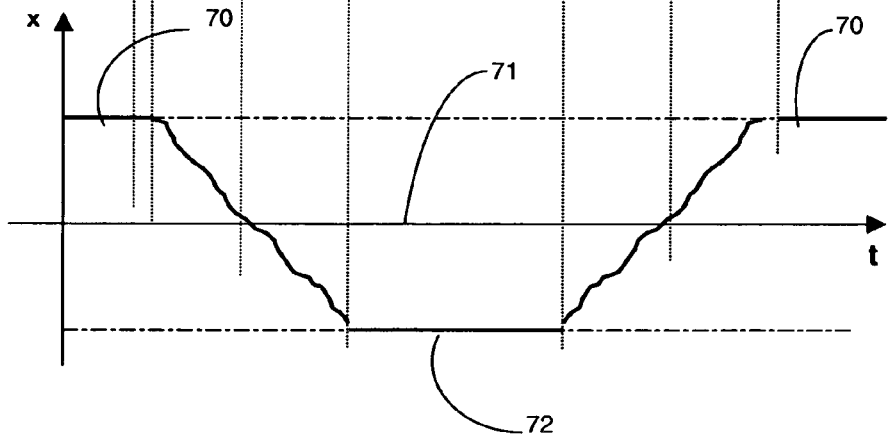
FIG. 8*b* represents a curve representative of the movement of the switching device according to FIGS. 3 to 7.

FIGS. 8*a* and 8*b* represent a chronological diagram of the different stages of operation described above. At the time f, a first cycle C of control orders is sent. A first current or impulse command C1 is sent to the coil 55. After a short delay corresponding to the time necessary for the electric current I to flow in the coil 55, the switching device leaves a first stable state 70. The magnet 7 is repelled from the base 23 and moves in the direction of the second base 22. This movement, corresponding to an unstable state of the device, is broken down into two periods represented respectively between times f and g and between times g and h. During the period elapsing chronologically between the times f to g, the distance X1 covered by the magnet 7 increases due to the repulsion force generated by the first impulse C1 as represented in FIG. 5. The inertia of the magnet 7 enables it to cover a distance X1 greater than half the total air gap X as represented in FIG. 6. In a particular embodiment of the control circuit 45, when the magnet is in an intermediate position 71 where the distance X1 is preferably greater than half of X, a second command or impulse C2 sends a current I flowing in the opposite direction to the coil. At the end of travel, when the magnet 7 is located on the base 22 at the time h, the power supply of the coil is preferably interrupted and the device is in a second stable state 72. In this control mode, the coil 55 generates a repulsion force followed by an attraction force.

To revert to the initial stable state 70, the same cycle C of electric control orders C1 and C2 is sent. At a time m, a current I flowing in the coil causes movement of the magnet by repulsion. The device leaves its stable state 72, passes via an unstable state between times m and 0 and finally reaches the second stable state 70.

In order to simplify the electronic control circuit 45 and to reduce the number of components used, it can be envisaged to reduce the number of control orders of each cycle C. In practice, the second current or impulse command C2 can be eliminated. Thus, when the device is in an intermediate state 71, approximately at the times g or n, the coil 55 is no longer supplied. The magnet 7 will then continue its movement due to the effect of the inertia forces and will finally come into contact with the second base. In this case, command of the coil only generates repulsion forces causing movement of the magnet 7. At the end of travel, attraction of the magnet 7 to the bases made of magnetic or magnetizable materials takes place without the action of the coil.

The device as represented in FIGS. 3 to 7 is particularly designed for remote-controlled electric switches.

Figure 9:
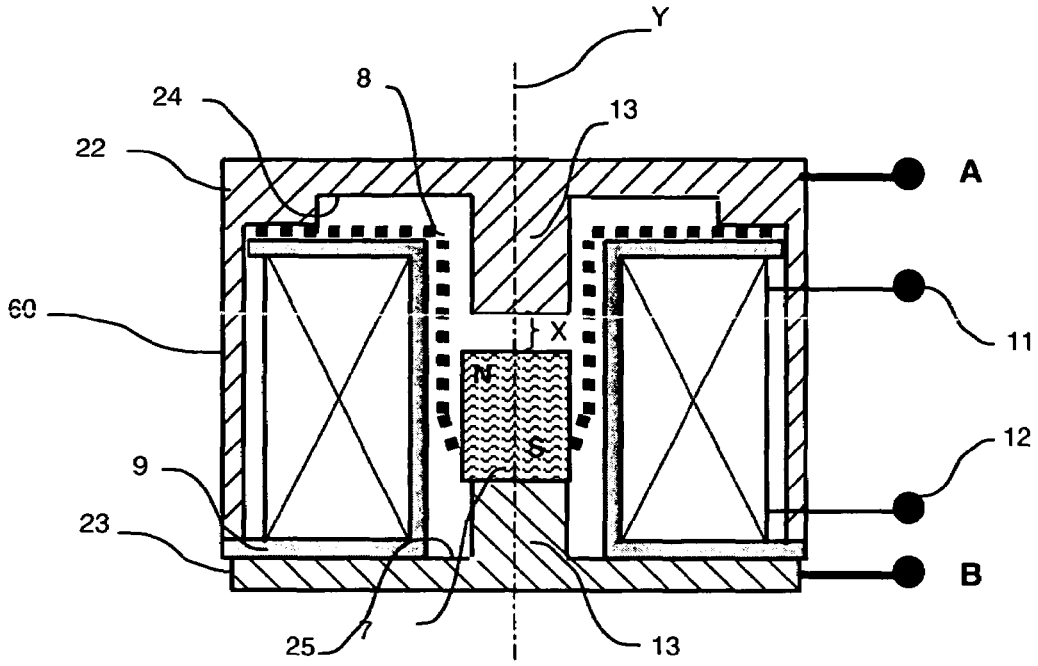
FIG. 9 represents a cross-sectional view of a first alternative embodiment of the device according to FIG. 3.

According to a first alternative embodiment represented in FIG. 9, studs 13 are arranged salient on the internal faces of the bases 22 and 23. This structure enables the length of the permanent magnet to be reduced while keeping the same length of the total air gap X. This notably enables the costs of the permanent magnet 7 to be reduced.

In addition, to enable the electromagnetic field lines to close and to magnetize the bases 22, 23, a side wall made of magnetizable material 60 extends between the two bases 22, 23. To avoid a short-circuit between the terminals A and B, an insulating part 9 is inserted between the bases.

According to a first preferred embodiment, the actuating device 5 comprises a coil 55 the winding whereof is made up of two sections 56, 57. Winding of the wire on the first section 56 is performed in a first rotation direction and winding of the wire on the second section 57 is performed in a second rotation direction contrary to the first direction. In the embodiment represented in FIGS. 10 to 12, the lengths of the two windings are substantially equal.

Figure 10:
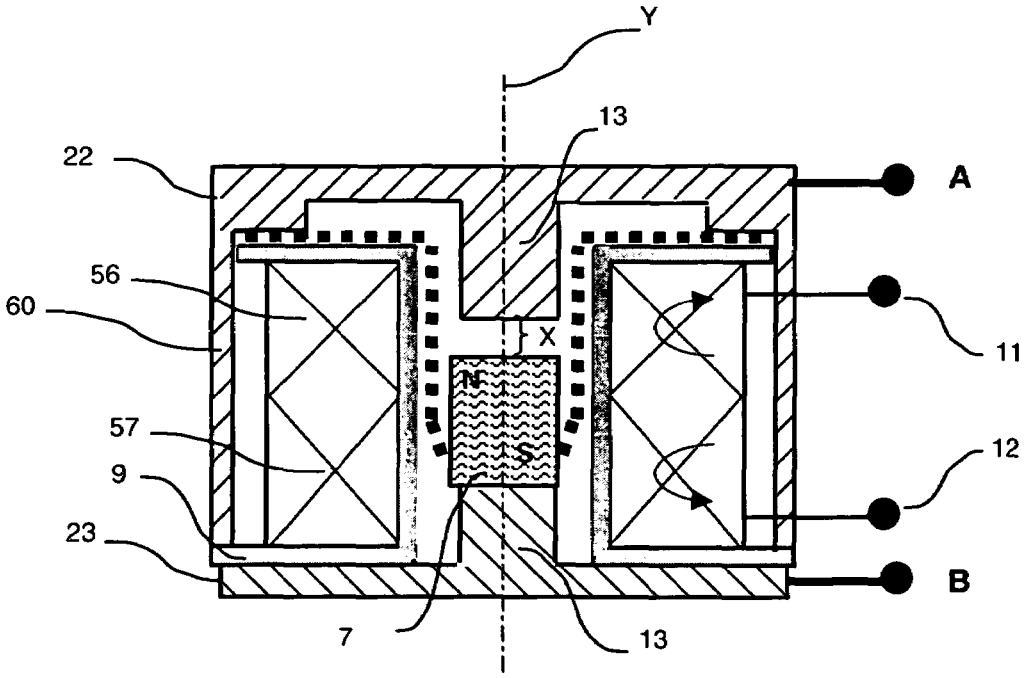
FIGS. 10 to 12 represent cross-sectional views of a first preferred embodiment of the device according to FIG. 3.
Figure 12:
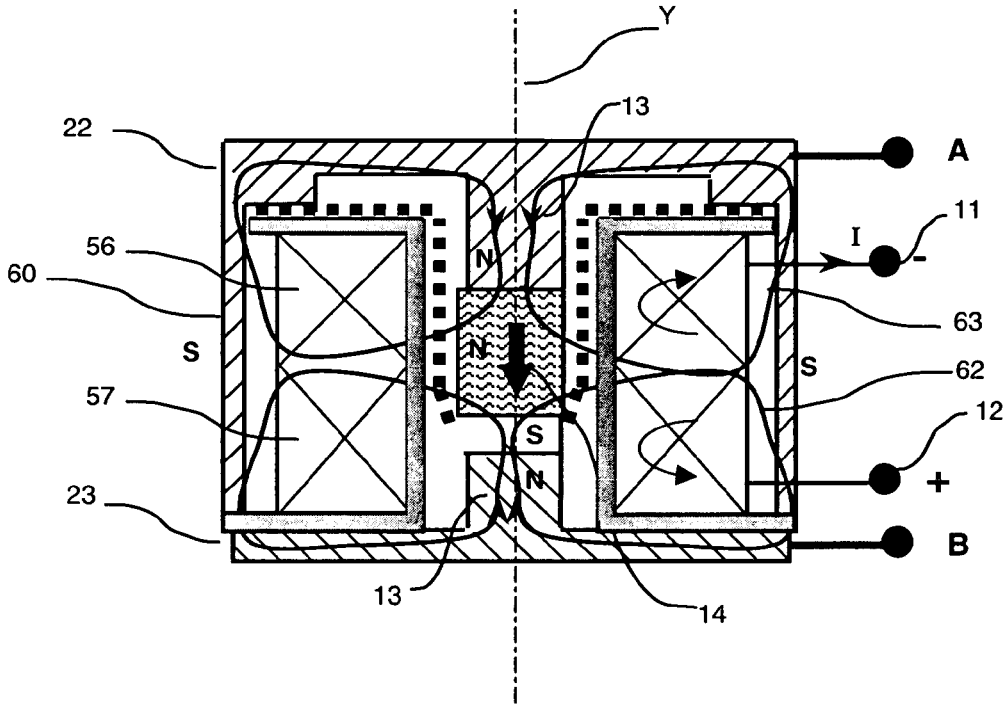

For example, to switch from a closed state as represented in FIG. 10 to an open state as represented in FIG. 12, the operating mode of the device is then the following. Chronologically, as represented in FIGS. 13*a* and 13*b*, at a time e, before a control order is sent to the actuating device 5, said device is in a first stable state 70.

Figure 11:
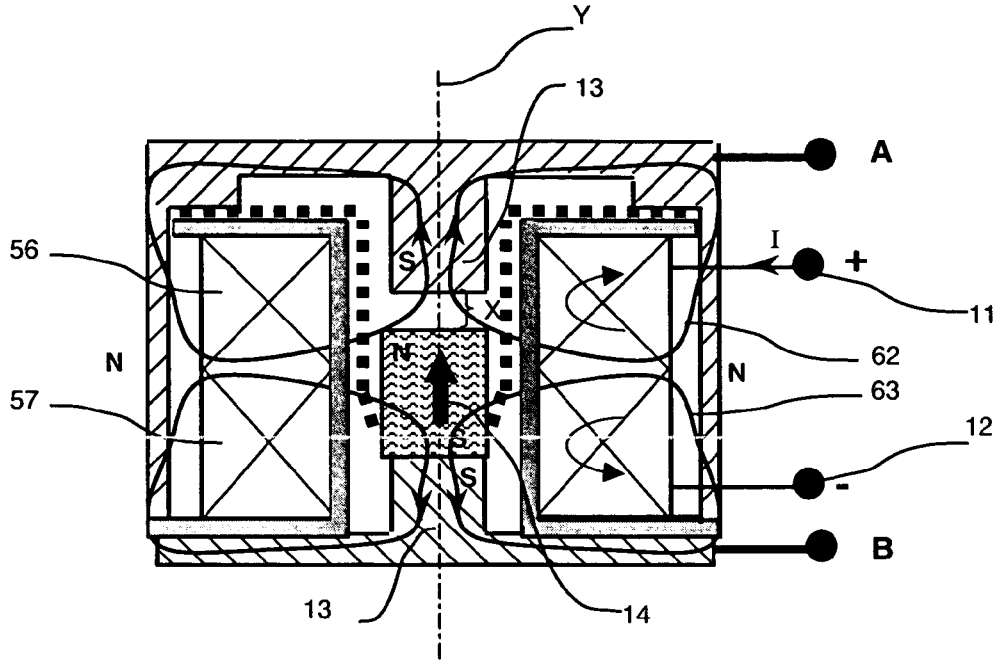

At a time f, a first control order C1 is sent to the coil 55 via the inputs 11, 12. After a short delay corresponding to the time necessary for the electric current I to flow in the coil 55, the local electromagnetic fields created by the two winding sections 56, 57 of the coil 55 enable the bases 22 and 23 to be magnetized with identical magnetic poles. The two winding sections in fact respectively create local magnetic fields the field lines whereof 62, 63 rotate in opposite directions. In the embodiment as represented in FIG. 11, the base 22 and base 23 become South poles.

A repulsion force is generated between the South pole of the magnet 7 and the South pole of the base 23. This force tends to repel the magnet which is in contact with the internal face 25 of the base 23 in the direction 14. Moreover, an attraction force is generated between the North pole of the magnet 7 and the South pole of the base 22. This force tends to attract the magnet towards the base 22.

The magnet is thus subjected simultaneously to two electromagnetic forces that act at the same time and in the same direction to make it move in the same direction 14.

The switching device 1 then leaves the first stable state 70. The magnet 7, repelled from the first base, starts to move in the direction of the second base. This movement, corresponding to an unstable state of the device, is comprised between the times f and h1.

At the end of travel, when the magnet positions itself on the base 22 at the time h1, the terminals A, B are then open and the device is in a stable open state 72. Then, at the time h2, the power supply of the coil can then be interrupted and the bases are no longer polarized by said coil.

The duration of the impulse C1 between the times f and h2 is then advantageously greater than the duration of the total travel of the magnet 7 moving from the first base to the second base.

To reclose the electric terminals A, B of the switching device 1, a second control order C2 is sent at a time m. The direction of the electric current I flowing in the coil 55 is then reversed as represented in FIG. 12. The North pole of the magnet that is in contact with the internal face of the base 22 is repelled in the direction 14. Moreover; the magnet 7 is attracted by the base 23. When, at the time O1, the magnet 7 comes into contact with the internal face 25 of the base 23, the terminals A, B are again in the closed position. The power supply of the coil 55 can then be interrupted at the time O2 and the bases 22, 23 are no longer polarized by said coil.

FIGS. 15 to 18 represent embodiments of the switching device 1 designed to be used in a plinth 29 of a socket 40. The bases 22, 23 of the switching device 1 then respectively comprise a sleeve 31 and a power supply terminal 30. The power supply terminals 30 comprise means 32 for clamping the power supply cables or wires.

Figure 15:
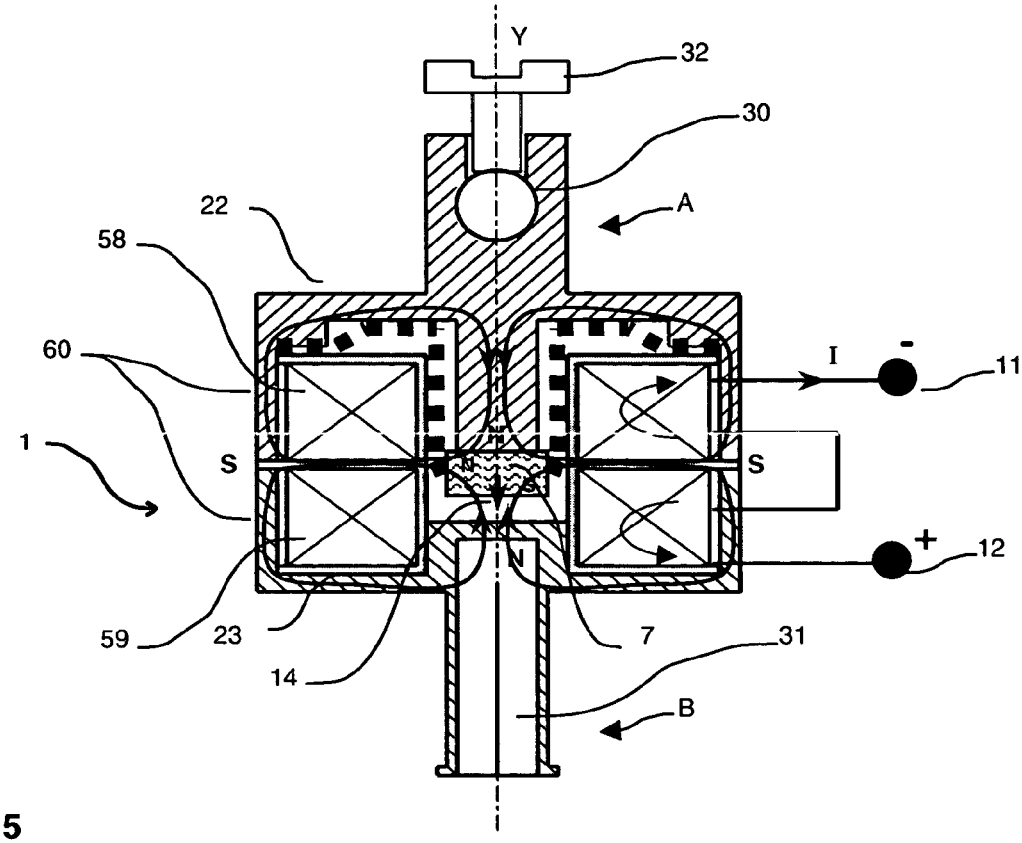
FIG. 15 represents a cross-sectional view of an alternative embodiment of the device according to FIG. 3.

In FIG. 15, an alternative embodiment of the actuating device 5 comprises two electrically connected adjacent coils 58, 59. The winding direction of the wires of these two coils 58, 59 generates opposite magnetic fields. In the embodiment represented in FIG. 15, the lengths of the two windings are substantially equal. The electric inputs 11, 12 of the actuating device are respectively connected to the coils 58 and 59. Operation of this alternative embodiment is similar to that of the first preferred embodiment as represented in FIGS. 10 to 12 and described above.

Figure 16:
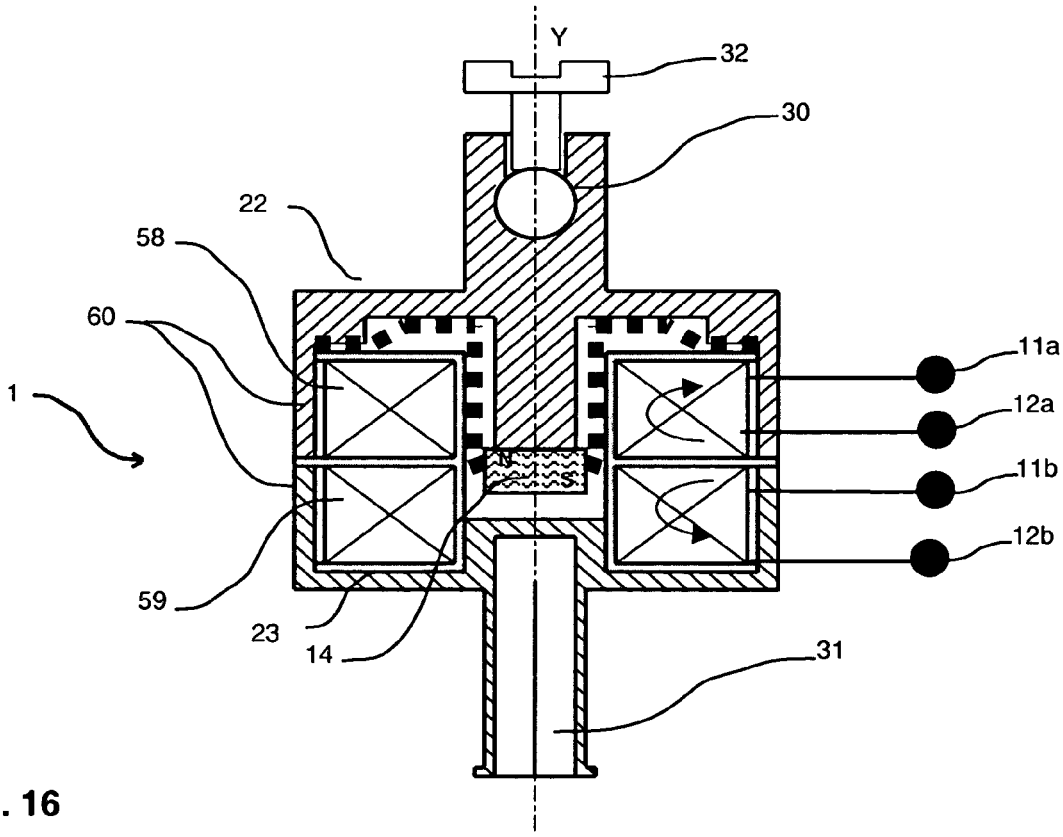
FIGS. 16 to 18 represent cross-sectional views of a second preferred embodiment of the device according to FIG. 3.
Figure 17:
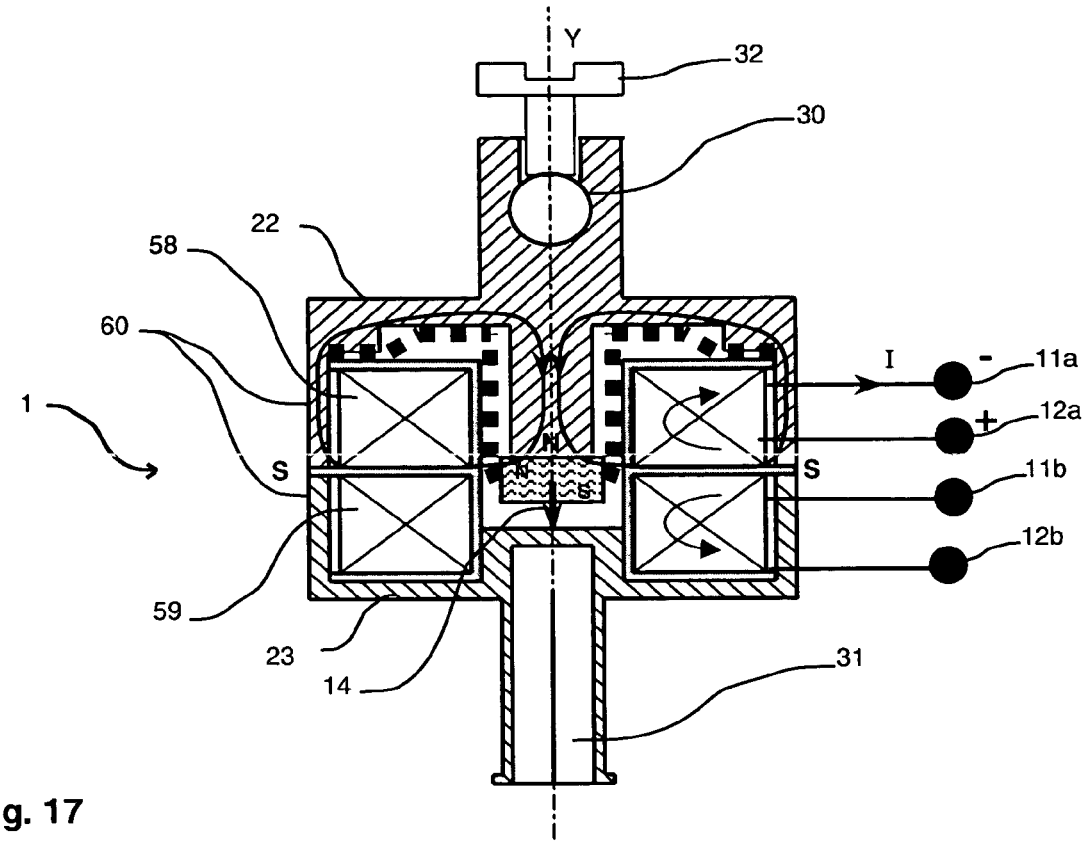
Figure 18:
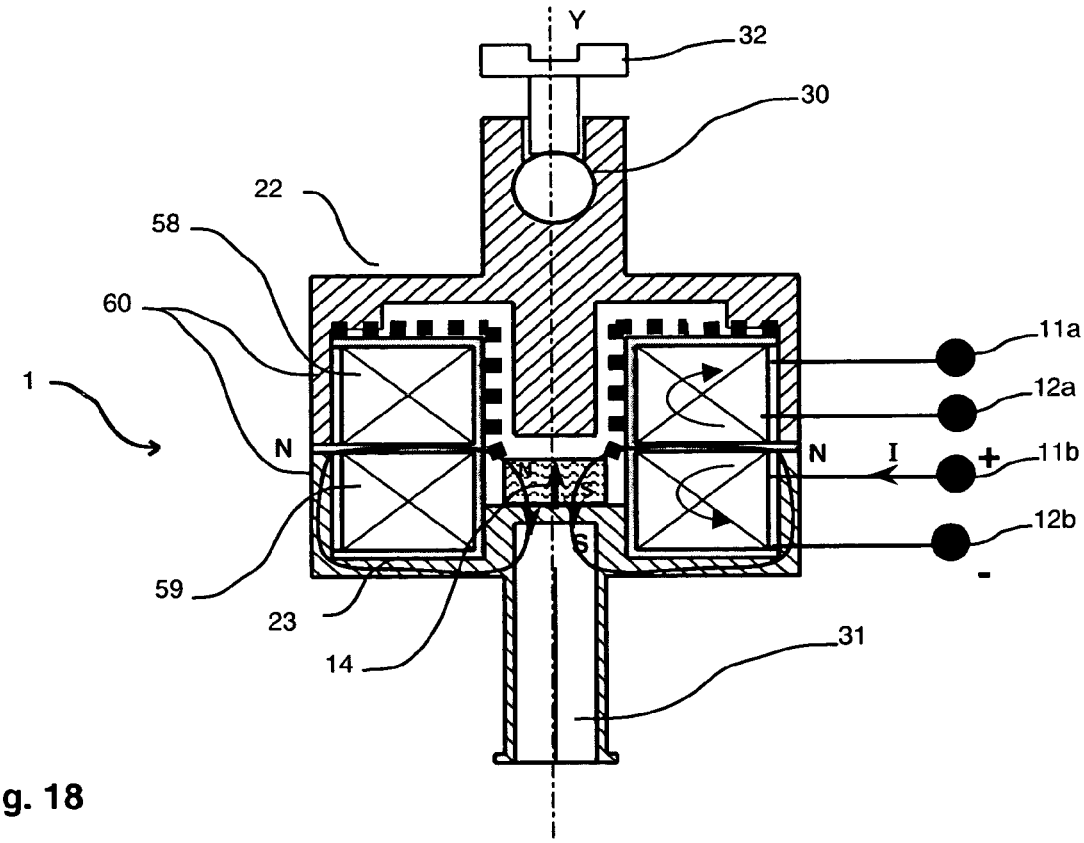

According to a second preferred embodiment of the invention represented in FIGS. 16 to 18, the actuating device 5 comprises two electrically independent adjacent coils 58, 59. The coils 58, 59 are respectively electrically supplied between inputs 11*a*, 12*a* and 11*b*, 12*b*. The winding direction of the wires of the two coils 58, 59 and the choice of electric polarity of the inputs 11*a*, 11*b*, 12*a* and 12*b* enable the magnet 7 to be moved from the base 22 to the base 23 and vice-versa. In the embodiment represented in FIG. 16, the winding directions of the wires of the two coils 58, 59 are opposite and the lengths of the two windings are substantially equal.

Figure 19A:
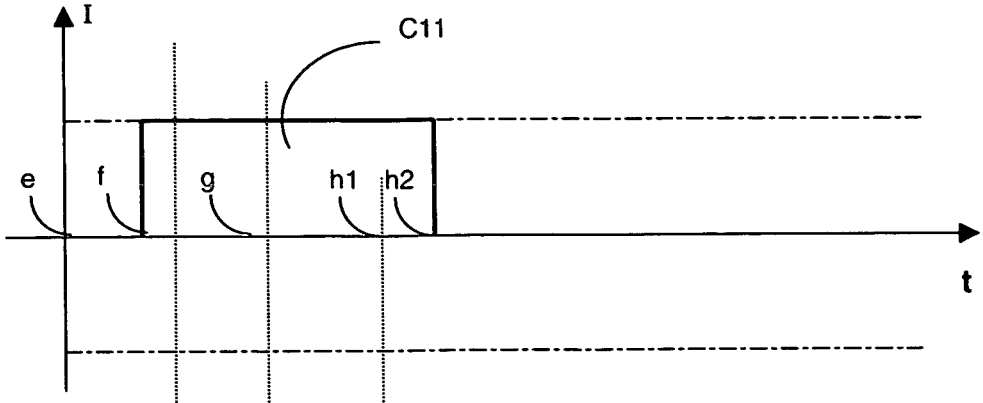
FIGS. 19*a* and 19*b* represent curves representative of the control signals of the switching device according to FIGS. 16 to 18.

As represented in FIG. 17, the device is in a first stable state 70, and the terminals A and B are in the open position. To switch from the open position to a closed position, the operating mode of the device is then the following. In FIG. 19A, a first control order or impulse C11 is sent to the coil 58, and the terminals 11*a* and 12*a* are then supplied respectively negatively and positively. The electric current I flowing in the coil 58 generates a local magnetic field. Said field enables the stud 13 of the base 22 to be magnetized. In the embodiment as represented in FIG. 17, the stud of the base 22 then becomes a North pole. The base 23 does not have any magnetic polarity.

A repulsion force is generated between the North pole of the magnet and the North pole of the base 22. This force tends to repel the magnet which is in contact with the internal face 24 of the base 22. The magnet is subjected to an electromagnetic force which tends to make it move in the direction of movement 14.

After the magnet has moved between the two bases, it positions itself on the base 23, and the terminals A, B are then closed. The power supply of the coils can then be interrupted, and the magnetic pole of the base 22 disappears. The device is in a stable closed state 72 with the magnet in contact with the base 23.

Figure 19B:
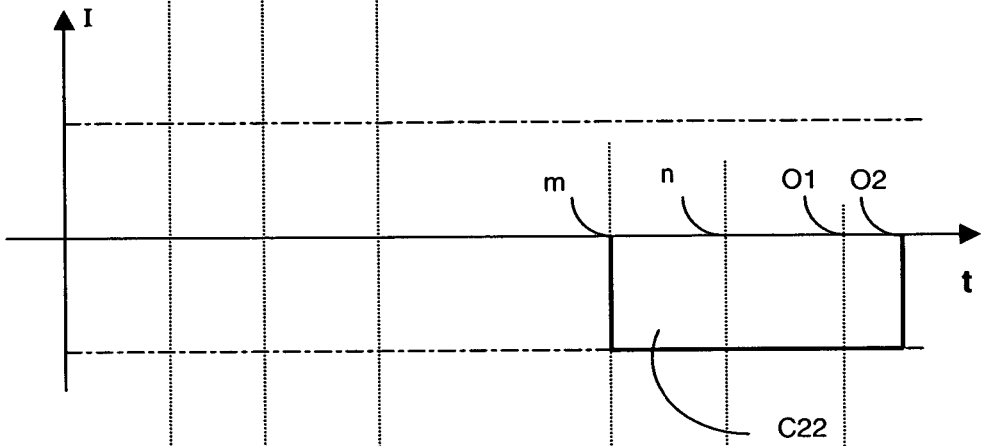
Figure 19C:
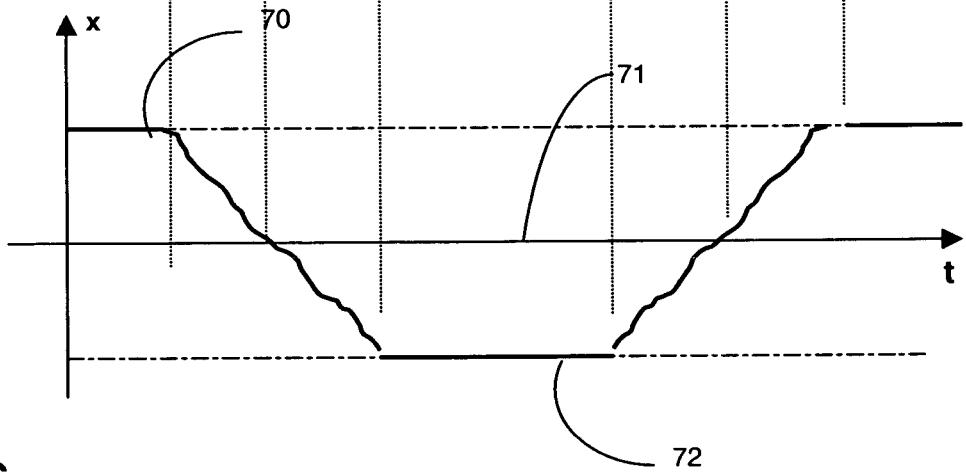
FIG. 19*c* represents a curve representative of the movement of the switching device according to FIGS. 16 to 18.

To open the device, a second control order C22 is sent to the second coil 59 as represented in FIG. 19B. The terminals 11*b* and 12*b* are then supplied respectively positively and negatively. The electric current I flowing in the coil 59 generates a local magnetic field. Said field enables the stud 13 of the base 23 to be magnetized. In the embodiment as represented in FIG. 18, the stud of the base 23 then becomes a South pole. The base 22 does not have any magnetic polarity.

A repulsion force is generated between the South pole of the magnet and the South pole of the base 23. This force tends to repel the magnet which is in contact with the internal face 25 of the base 23. The magnet is subjected to an electromagnetic force which tends to make it move in the direction of movement 14.

After the magnet has moved between the two bases, it positions itself on the base 22, and the terminals A, B are then open. The power supply of the coils can then be interrupted and the magnetic pole of the base 23 disappears. The device is in a stable open state 70 with the magnet in contact with the base 22.

In this embodiment of the invention, at each repulsion command causing a movement of the magnet between the bases 23 and 22, a single control order C11 or C22 is sent to one of the two coils 58 or 59 only.

Figure 20:
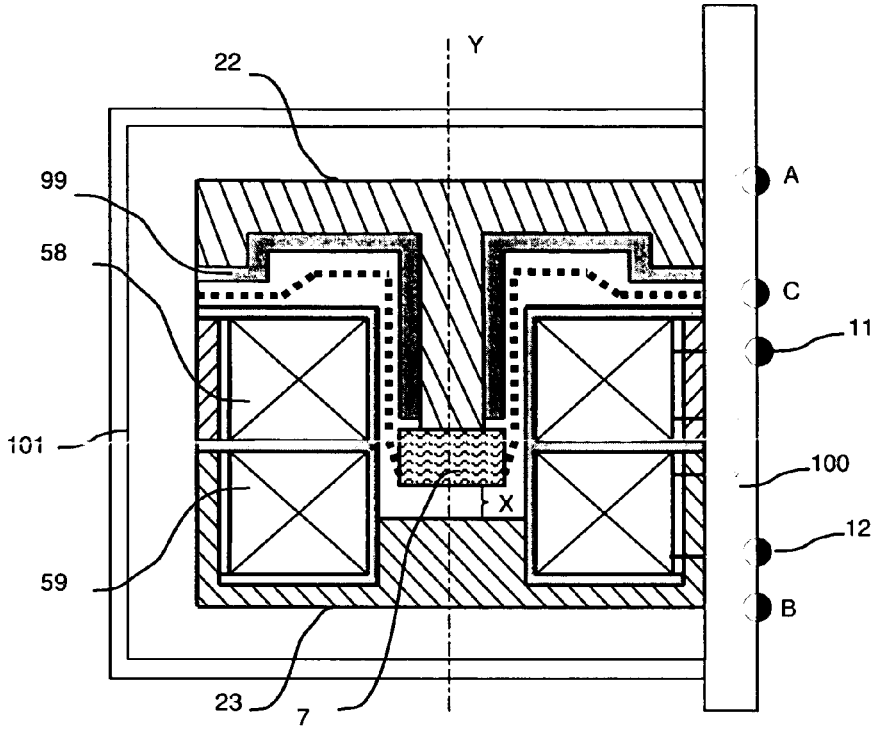
FIG. 20 represents a cross-sectional view of a relay comprising a switching device according to an embodiment of the invention.

In another alternative embodiment of the invention, in particular a relay, represented in FIG. 20, the flexible connection 8 is connected to a third electric terminal C distinct from the terminals A and B. An additional electric insulator 99 is then used to separate the flexible connection 8 from the base 22 on which the connection was previously fixed. The magnet then has two electric contact zones able to collaborate respectively with the two bases 22, 23. The movement of the movable part 2, in particular of the magnet 7, from a first stable position to a second stable position enables the terminals A and C then the terminals C and B to be successively connected. In the embodiment presented, the electric terminals are welded onto a printed circuit plate 101 acting as support for a cover 100 housing the switching device 1 called a changeover switch.

The devices as represented in FIGS. 10 to 20 are particularly intended for electric relays called bistable relays.

In another alternative embodiment of the invention represented in FIGS. 21 to 26, an electric apparatus comprises a switching device 1 and thermal tripping means 73 and mechanical resetting means 80.

The thermal tripping means 73 enable the terminals A and B to be opened in case of an electric overload of the switching device 1. They comprise a bimetal strip 75 associated to an operating pin 76.

Figure 24:
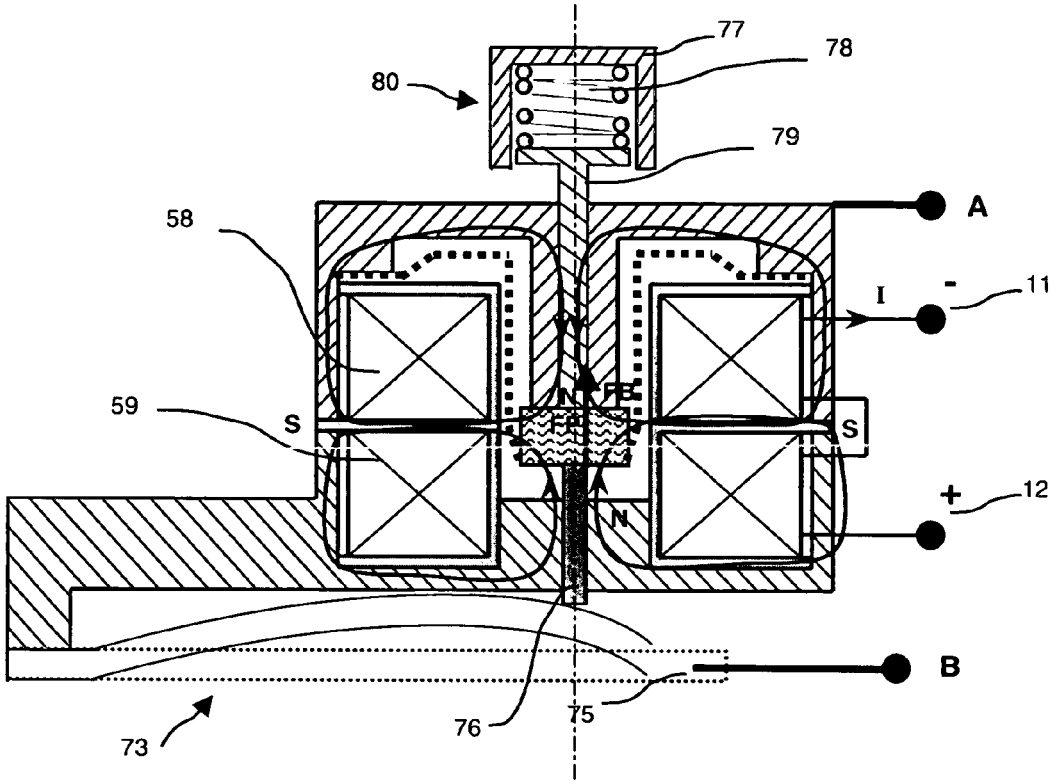
Figure 25:
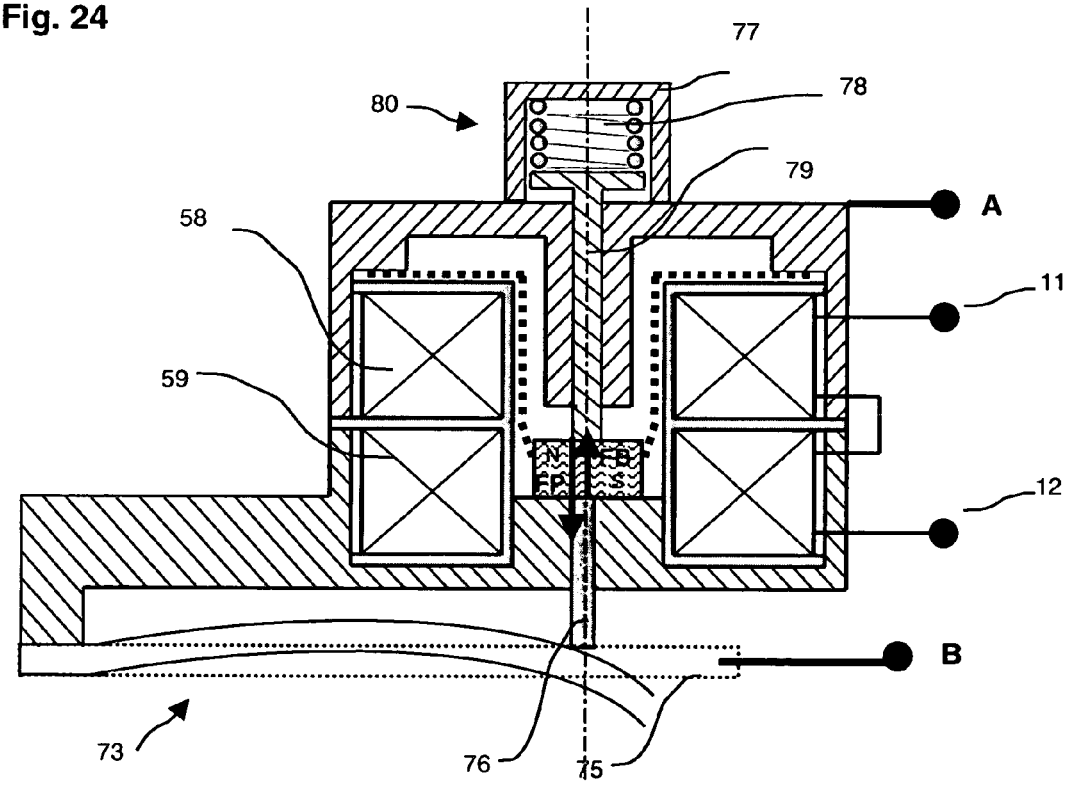
Figure 26:
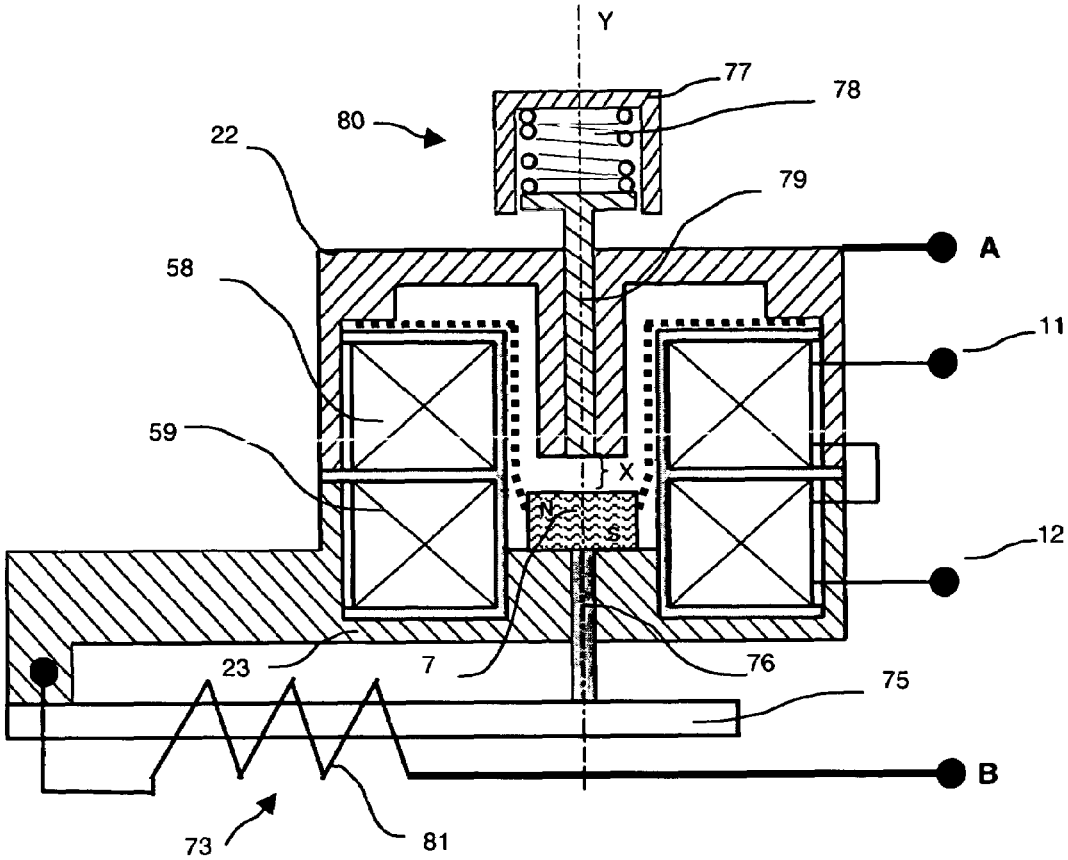
FIGS. 26 and 27 represent alternative embodiments of the apparatus according to FIG. 21.

As represented in FIGS. 21 to 25, the bimetal strip 75 can be connected directly to one of the electric terminals B of the switching device 1. In addition, as represented in FIG. 26, the bimetal strip 75 may not be in electric contact with the electric terminals A, B. A winding 81 surrounding the bimetal strip 75 is then connected directly to one of the electric terminals B.

The operating pin 76 is an electric insulator. A first end of said pin is permanently connected to the bimetal strip 75. The longitudinal axis of the operating pin 76 is preferably the same as the longitudinal axis Y of the coils 58, 59. Moreover, the operating pin 76 is mounted sliding through one of the bases, preferably the base 23.

Flow of a too large electric current inside the bimetal strip 75 or inside the winding 81 causes a temperature rise of said bimetal strip and therefore a deformation thereof. This deformation of the bimetal strip 75 is transmitted to the operating pin 76 via its first end and causes a movement in translation of said pin 76 in a direction parallel to the longitudinal axis Y of the coils 58, 59.

Thus, depending on the respective positions of the magnet 7 and of the operating pin 76, the second end of said pin can be in contact with said magnet.

The mechanical resetting means 80 enable the terminals A and B to be closed manually when the magnet is on the base 22. The mechanical resetting means 80 comprise a press-button 77 able to act on a second operating pin 79 by means of flexible means 78. A first end of the second operating pin 79 is permanently connected to the flexible means 78. The longitudinal axis of the operating pin 79 is preferably the same as the longitudinal axis Y of the coils 58, 59. Moreover, the operating pin 79 is mounted sliding through one of the bases, preferably the base 22. An action on the press-button 77 is transmitted to the operating pin 79 via its first end and causes a movement of said pin 79 in translation in a direction parallel to the longitudinal axis Y of the coils 58, 59.

Figure 21:
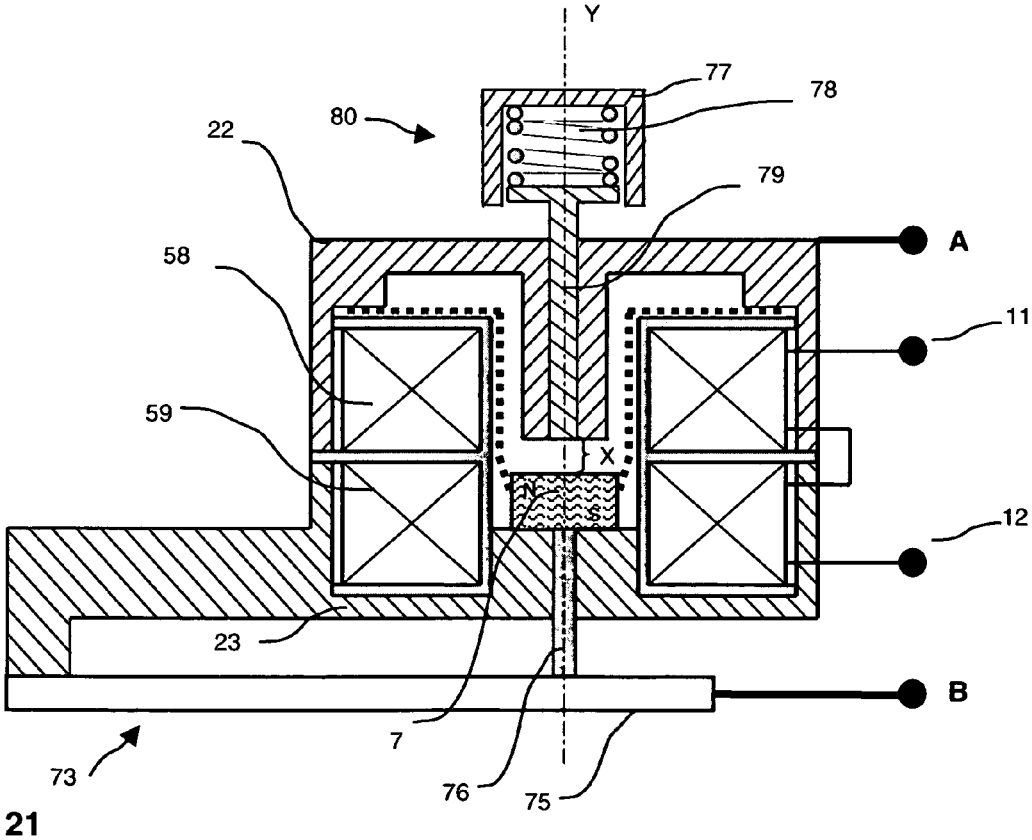
FIG. 21 represents a cross-sectional view of an apparatus comprising a switching device according to an embodiment of the invention and of the thermal tripping means.

FIG. 21 represents the device in the stable operating position. The terminals A and B are then closed, and the bimetal strip 75 has not undergone any deformation due to a temperature rise.

Figure 22:
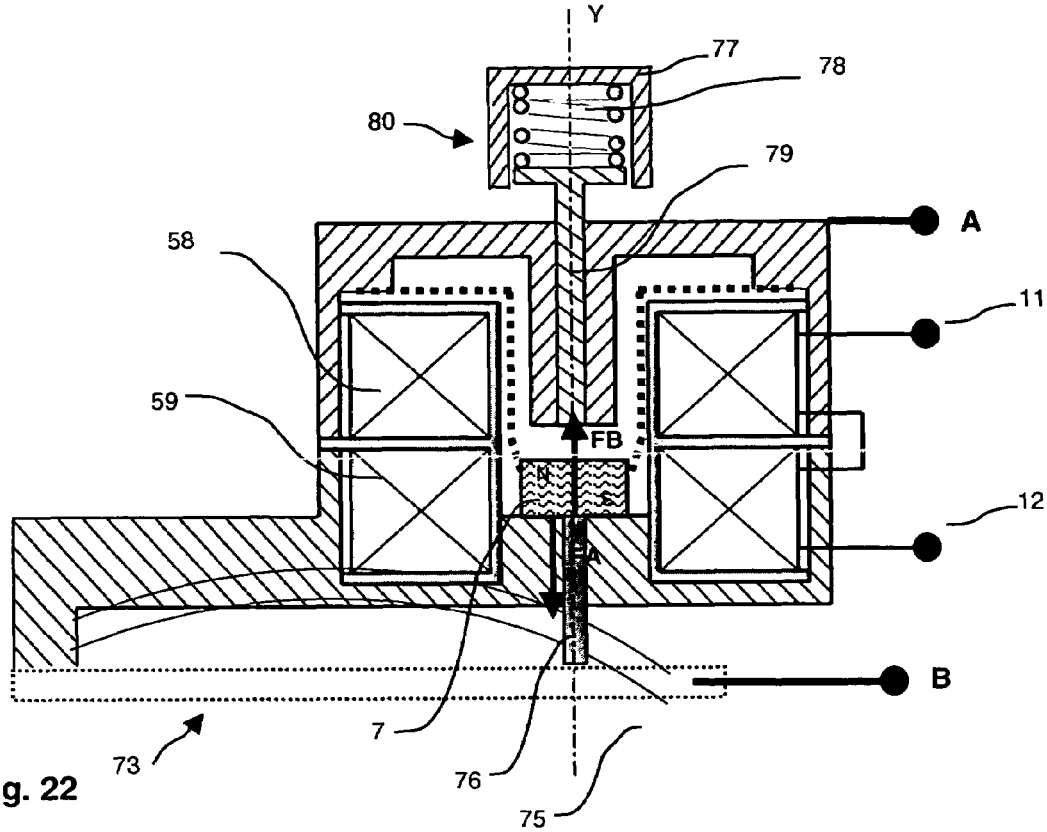
FIGS. 22 to 25 represent the apparatus according to FIG. 21 in different operating states.

When the device is subjected to an electric overload, the bimetal strip 75 is deformed as represented in FIG. 22. This deformation of the bimetal strip 75 then tends to make the operating pin 76 move towards the magnet 7. An increasing unsticking force FB is then applied to the magnet 7 by means of the operating pin 76. This force FB tends to oppose the magnetic attraction force FA of the magnet onto the first base 23. The force FA depends directly on the intrinsic characteristics of the magnet 7.

Figure 23:
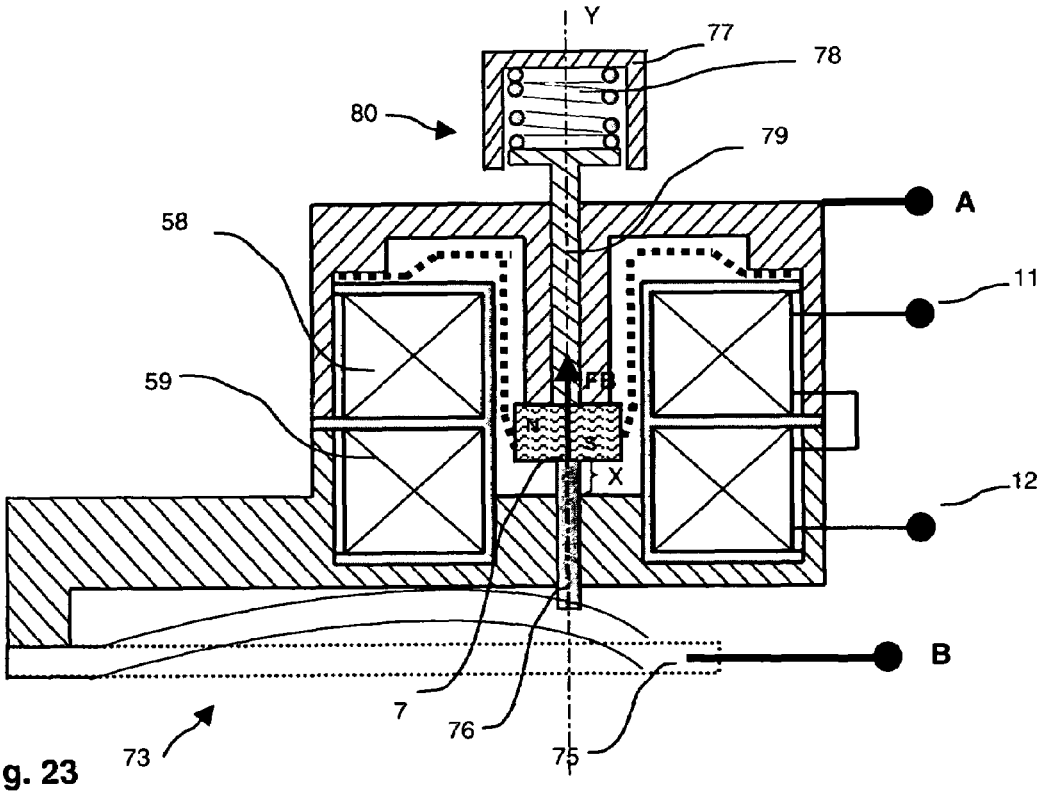

At the beginning of the temperature rise, when the deformation of the bimetal strip 75 is still small, the unsticking force FB is much lower than the magnetic attraction force FA. The force FB increases with the progressive deformation of the bimetal strip 75. Beyond a certain deformation, the intensity of the force FB becomes much greater than the force FA and causes an abrupt unsticking of the magnet 7 from the first base 22. As represented in FIG. 23, the magnet 7 will then move to stick on the second base 23. The switching device 1 is then open.

Resetting of the device can be performed by means of two types of means. Either the electric switching means 58, 59 as represented in FIG. 24 or the mechanical resetting means 80 as represented in FIG. 25 can be used.

When the press-button 77 is depressed, the flexible means 78 having undergone a deformation exert a compression force FP on the second operating pin 79. This compression force FP then acts directly on the magnet 7 which is located on the base 22 and tends to unstick it from the latter. The stiffness of the flexible means 78 is calibrated so as to be able to unstick the magnet 7 from the base 22 when the force FB exerted on the magnet 7 by the first transmission pin 76 is minimal. In other words, if the bimetal strip 75 has not reverted to its original shape and is still exerting a force FB on the magnet 7 via the operating pin 76, the mechanical resetting means 80 are inoperative.

If the electric fault causing the overload is cleared, the bimetal strip 75 will cool and revert to its initial shape. The unsticking force FB tends to zero.

This type of apparatus then comprises two types of resetting. Mechanical resetting 80 by means of the press-button 77 and electromagnetic resetting composed essentially of the switching device 1.

Furthermore, the switching device 1 also keeps its initial remote opening and closing control functions. Electric control of the coils 58 and 59 can be performed remotely whereas the mechanical resetting means 80 are preferably commanded by an operator situated next to the device.

Figure 27:
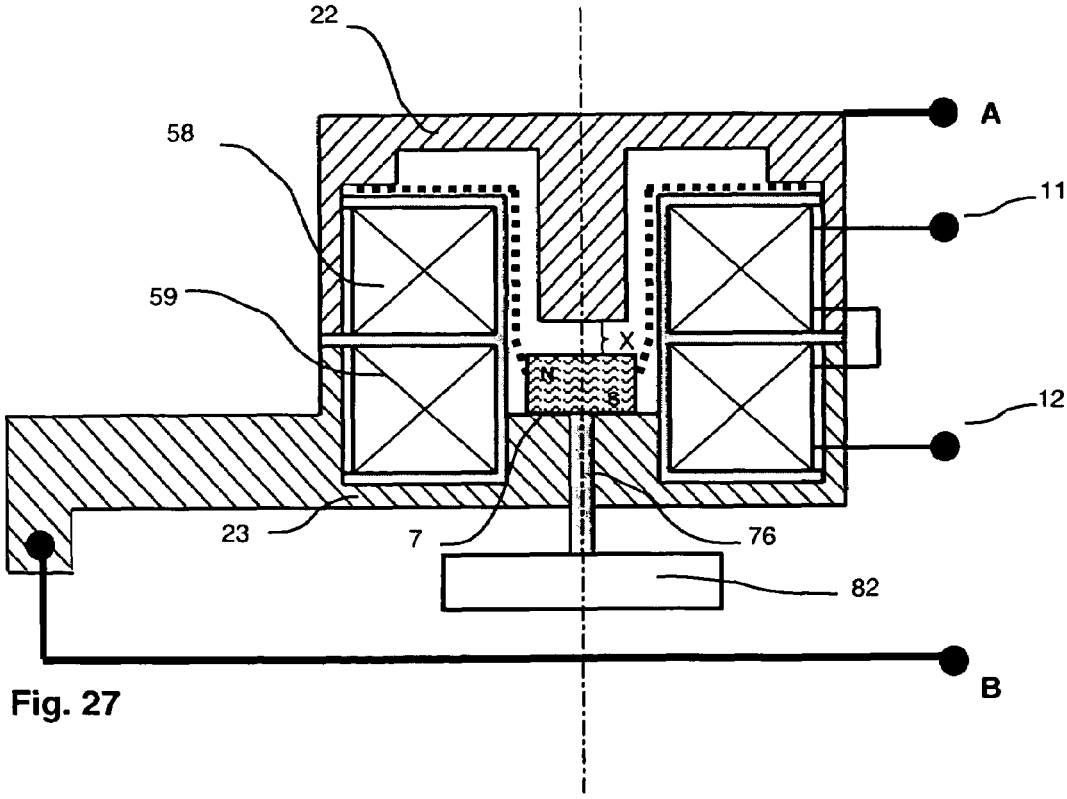

In another alternative embodiment of the invention represented in FIG. 27, an electric apparatus comprises a switching device 1 and thermal tripping means. This type of apparatus is particularly intended to be used as a thermal circuit breaker or as an electric thermostat. The thermal tripping means 82 enable the terminals A and B to be opened in case of an increase of the ambient temperature of the environment in which said apparatus is located. The thermal tripping means 82 are associated to an operating pin 76. As in the previous example, deformation of the thermal tripping means 82 due to a temperature increase causes a movement of the operating pin 76 which acts on the movable part, in particular the magnet 7 of the switching device 1.

Figure 28:
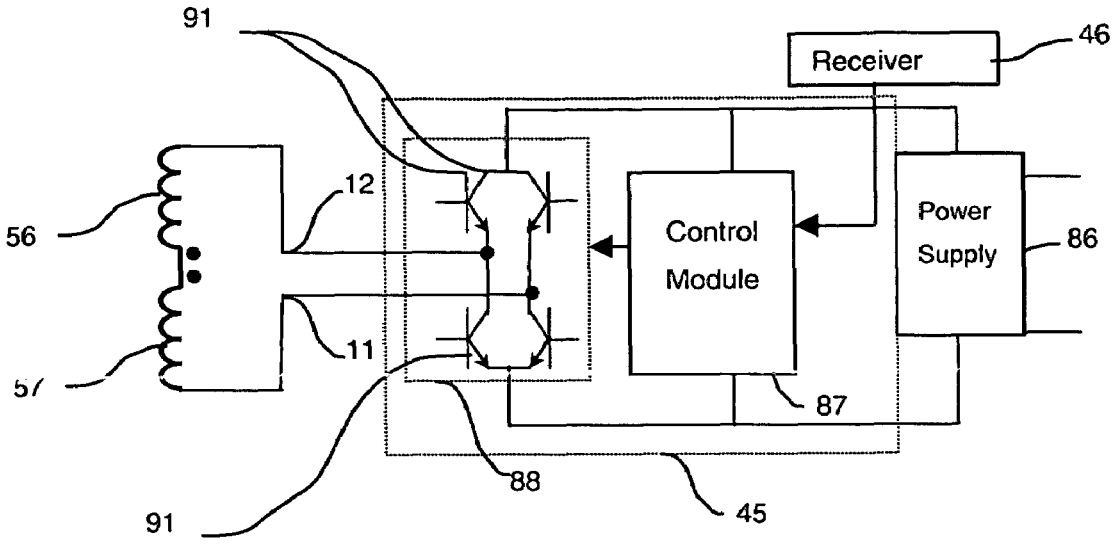
FIGS. 28 and 29 represent alternative embodiments of the control module of the switching device according to an embodiment of the invention.
Figure 29:
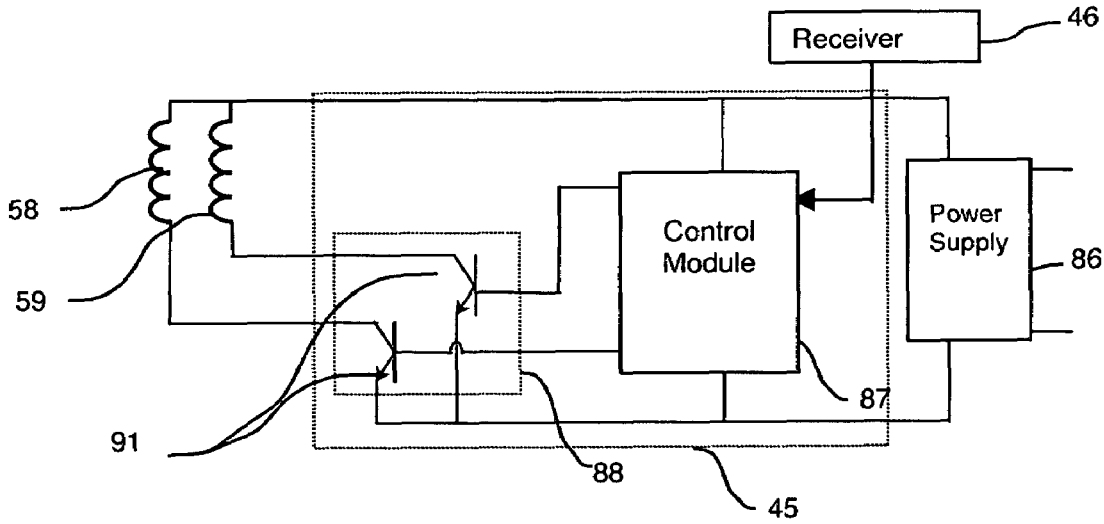

FIGS. 28 and 29 represent alternative embodiments of a control module 45 of the actuating device 5.

According to a first embodiment as represented in FIG. 28, the control module 45 is designed in particular to control switching devices according to FIGS. 10 to 12. It comprises a circuit 88 composed of four power transistors 91 mounted in known manner in the form of an H. The windings 56, 57 are connected to said transistors. The transistors 91 are controlled via a control circuit 87 supplied by a source 86 and receiving control orders from a receiver module 46.

According to a second embodiment as represented in FIG. 29, the control module 45 is designed in particular to control switching devices according to FIGS. 16 to 18. It comprises a circuit 88 composed of two power transistors 91 respectively connected to the coils 58 and 59. The transistors are controlled via a control circuit 87 supplied by a source 86 and receiving control orders from a receiver module 46.

Figure 2:
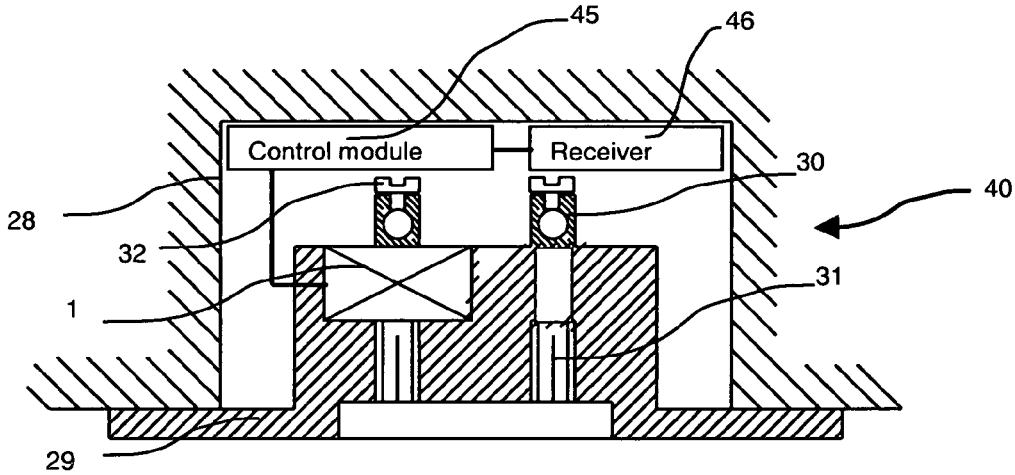
FIG. 2 is a schematic cross-sectional view of a socket comprising a switching device according to an embodiment of the invention.

The switching device 1 according to the different embodiments of the invention can be intended for control of electric current sockets 40. FIG. 2 represents an electric socket in which a switching device 1 according to the embodiments of the invention has been placed. Said switching device 1 is placed respectively between the sleeves 31 and the power supply terminals 30 and therefore enables the two electric poles of the socket 40 to be cut simultaneously or separately.

A control module 45 placed in the volume 28 and supplied between the terminals 30 enables opening or closing of the switching device 1 to be controlled.

External electric control orders of the switching devices can be received notably by receiver modules 46 connected to the control module 45. External orders can also be transmitted by other means such as carrier currents.

The invention claimed is:

1. Switching device comprising:

a contact block having a movable part and a fixed part, the fixed part connected to at least one electric terminal and having at least one electric contact zone able to be in contact with a contact zone of the movable part, the fixed part comprising an actuating device for moving the movable part from a closed position to an open position of said electric contact zones, said actuating device comprising at least one electromagnetic coil placed between two bases made of magnetic or magnetizable material and electrically insulated from one another, said at least one electromagnetic coil for magnetizing said bases, at least one first base of said two bases being connected to a first electric terminal, and the movable part comprises at least one magnet inside said at least one electromagnetic coil and comprising at least one electric contact zone between said two bases and electrically connected to a second electric terminal, wherein the actuating device is for moving the magnet from one base to the other between two stable positions respectively corresponding to a distinct electric state of the switching device such that in at least one of the two stable positions, said magnet is in electric contact with said first base connected to said first electric terminal.

2. Switching device according to claim 1 wherein the actuating device comprises an electric coil having a winding designed to create a magnetic field to polarize the bases with opposite magnetic polarities.

3. Switching device according to claim 1 wherein the actuating device comprises an electric coil having two winding sections connected in series and having opposite winding directions so that said sections respectively create opposite magnetic fields.

4. Switching device according to claim 1 wherein the actuating device comprises two coaxial electric coils connected in such a way as to create opposite magnetic fields.

5. Switching device according to claims 3 wherein the bases have the same magnetic polarities.

6. Switching device according to claim 1 wherein, in one of the two stable positions, the magnet comprises an electric contact zone in contact with a contact zone connected to a second electric terminal.

7. Switching device according to claim 1 wherein, respectively in each stable position, the magnet operates a magnetic attraction with one of the two bases.

8. Switching device according to claim 7 wherein the magnetic or magnetizable bases are respectively connected to two distinct connection terminals.

9. Switching device according to claim 8, wherein the magnet is electrically connected to one of the two bases by a flexible connection.

10. Switching device according to claim 8, wherein the magnet is electrically connected to a third electric terminal by a flexible connection.

11. Switching device according to claim 10, wherein, in both of the two stable positions, the magnet comprises an electric contact zone in contact with a contact zone respectively connected to a second electric terminal.

12. Switching device according to claim 1 wherein the movable magnet moves in a direction parallel to the longitudinal axis of the coils and inside the coils of the actuating device.

13. Switching device according to claim 1 wherein the metal bases have studs positioned salient on their internal faces, the studs of said bases being placed facing one another and aligned with the longitudinal axis of the coils.

14. Switching device according to claim 1 wherein a side wall made of magnetizable material extends between the two electrically insulated bases.

15. Relay comprising at least two electric contact terminals and at least two electric control inputs, comprising a switching device according to the claim 1, the coils of said device being connected to the control inputs and the bases of said device being connected to the contact terminals.

16. Electric apparatus comprising thermal tripping means and resetting means comprising a switching device according to claim 1 associated to the thermal tripping means and to the resetting means.

17. Electric apparatus according to claim 16, wherein the resetting means comprise a press-button acting on the movable part of the switching device via operating means.

18. Electric apparatus according to claim 16, wherein the thermal tripping means comprise a bimetal strip acting on the movable magnet via operating means.

19. Electric apparatus according to claim 16, wherein the thermal tripping means are electrically connected to one of the electric terminals.

20. Socket comprising a plinth whereon there are fixed at least two sleeves connected to connection terminals, comprising a switching device according to claim 1 connected between at least one sleeve and a connection terminal.

21. Socket according to claim 20 comprising a control module connected to the control inputs of the actuating device of the switching device, the control module sending a single repulsion control order or two consecutive repulsion and attraction control orders or two simultaneous attraction and repulsion control orders.

* * * * *